US007939013B2

(12) United States Patent
Norgren

(10) Patent No.: US 7,939,013 B2
(45) **Date of Patent: *May 10, 2011**

(54) COATED CEMENTED CARBIDE WITH BINDER PHASE ENRICHED SURFACE ZONE

(75) Inventor: Susanne Norgren, Huddinge (SE)

(73) Assignee: Sandvik Intellectual Property AB, Sandviken (SE)

( * ) Notice: Subject to any disclaimer, the term of this patent is extended or adjusted under 35 U.S.C. 154(b) by 198 days.

This patent is subject to a terminal disclaimer.

(21) Appl. No.: 12/318,087

(22) Filed: Dec. 22, 2008

(65) Prior Publication Data

US 2009/0180916 A1 Jul. 16, 2009

Related U.S. Application Data

(62) Division of application No. 11/406,527, filed on Apr. 19, 2006, now abandoned.

(30) Foreign Application Priority Data

Apr. 20, 2005 (SE) ..... 0500896

(51) Int. Cl.
*C22D 1/05* (2006.01)

(52) U.S. Cl. ..... 419/15; 419/14

(58) Field of Classification Search ..... 419/13, 419/15, 18, 48

See application file for complete search history.

(56) References Cited

U.S. PATENT DOCUMENTS

| | | | |
|---|---|---|---|
| 4,277,283 | A | 7/1981 | Tobioka et al. |
| 4,548,786 | A | 10/1985 | Yohe |
| 4,610,931 | A | 9/1986 | Nemeth et al. |
| 4,698,266 | A | 10/1987 | Buljan et al. |
| 4,843,039 | A | 6/1989 | Akesson et al. |
| 5,403,628 | A | 4/1995 | Konig et al. |
| 5,462,901 | A | 10/1995 | Egami et al. |
| 5,484,468 | A | 1/1996 | Östlund et al. |
| 5,549,980 | A | 8/1996 | Ostlund et al. |
| 5,761,593 | A | 6/1998 | Ostlund |
| 5,918,102 | A | 6/1999 | Friederichs |
| 6,071,469 | A | 6/2000 | Rohlin et al. |
| 6,228,139 | B1 | 5/2001 | Oskarsson |
| 6,267,797 | B1 | 7/2001 | Östlund et al. |
| 6,299,992 | B1 | 10/2001 | Lindskog et al. |
| 6,468,680 | B1 | 10/2002 | Waldenström et al. |
| 6,685,880 | B2 | 2/2004 | Engström et al. |
| 6,761,750 | B2 | 7/2004 | Zackrisson et al. |
| 7,220,480 | B2 | 5/2007 | Jansson et al. |
| 2002/0050102 | A1 | 5/2002 | Lenander et al. |
| 2002/0051871 | A1 | 5/2002 | Palmqvist et al. |
| 2002/0112896 | A1 | 8/2002 | Kruse et al. |
| 2002/0114981 | A1 | 8/2002 | Anderson et al. |
| 2003/0115984 | A1 | 6/2003 | Zackrisson et al. |
| 2003/0211366 | A1 | 11/2003 | Ruppi |
| 2004/0214050 | A1 | 10/2004 | Zackrisson et al. |
| 2005/0126336 | A1 | 6/2005 | Jansson et al. |
| 2007/0196694 | A1 | 8/2007 | Jansson et al. |

FOREIGN PATENT DOCUMENTS

| | | | |
|---|---|---|---|
| EP | 0 603 143 | B1 | 2/2000 |
| EP | 0 737 756 | B1 | 7/2002 |
| EP | 1 026 271 | B1 | 1/2003 |
| EP | 1 314 790 | A2 | 5/2003 |
| EP | 1 348 779 | | 10/2003 |
| EP | 1 043 416 | B1 | 9/2004 |
| EP | 1 043 415 | B1 | 1/2005 |
| EP | 1 526 189 | A1 | 4/2005 |
| JP | 56-112437 | A | 9/1981 |
| JP | 61-147841 | A | 7/1986 |
| JP | 63-297537 | A | 12/1988 |
| JP | 20-73946 | A | 3/1990 |
| JP | 2-228474 | A | 9/1990 |
| JP | 3-146668 | A | 6/1991 |
| JP | 3-146677 | | 6/1991 |
| JP | 11-61315 | | 3/1999 |
| JP | 2000-334608 | | 12/2000 |
| JP | 2002-038205 | | 2/2002 |
| JP | 2003-311510 | | 11/2003 |
| JP | 2004-232001 | | 8/2004 |
| WO | 93/17140 | | 9/1993 |
| WO | WO 96/22399 | | 7/1996 |
| WO | WO 03/010350 | A1 | 2/2003 |

OTHER PUBLICATIONS

Japanese Office Action mailed Mar. 16, 2010, in JP 2006-115790 (English translation).

Japanese Office Action mailed Mar. 16, 2020, in JP 2004-309742 (English translation).

*Primary Examiner* — Roy King
*Assistant Examiner* — Ngoclan T Mai
(74) *Attorney, Agent, or Firm* — Drinker Biddle & Reath LLP

(57) ABSTRACT

The present invention relates to a coated cemented carbide comprising WC, a binder phase based on Co, Ni or Fe and gamma phase and with a binder phase enriched surface zone essentially free of gamma phase. The gamma phase has an average grain size less than about 1 μm. In this way a binder phase enriched cemented carbide with improved toughness and essentially unchanged resistance against plastic deformation is obtained.

12 Claims, 1 Drawing Sheet

COATED CEMENTED CARBIDE WITH BINDER PHASE ENRICHED SURFACE ZONE

RELATED APPLICATION DATA

This application is a division of application Ser. No. 11/406,527 filed Apr. 19, 2006, now abandoned. This application claims priority under 35 U.S.C § 119 and/or §365 to Swedish Application No. 0500896-6, filed on Apr. 20, 2005, the entire contents of which are incorporated herein by reference.

BACKGROUND OF THE INVENTION

The present invention relates to a coated cemented carbide with a binder phase enriched surface zone essentially free of gamma phase comprising WC, a metallic binder based on Co, Ni or Fe and submicron gamma phase.

Cemented carbide grades for metal cutting applications generally contain WC with an average grain size in the range of from about 1 to about 5 μm, gamma phase, a cubic solid solution of at least one of TiC, NbC, TaC, ZrC, HfC and VC, substantial amounts of dissolved WC, and from about 5 to about 15 wt-% binder phase, generally Co. Their properties are optimized by varying the WC grain size, volume fraction of the binder phase and/or the gamma phase, the composition of the gamma phase and by optimizing the carbon content.

The gamma phase increases the hot hardness and also the chemical wear resistance of cemented carbides. It is formed by adding cubic carbides such as NbC, TaC, TiC, ZrC and HfC or mixed carbides of the same elements to a cemented carbide powder. The gamma phase formed during sintering grows by a dissolution and precipitation process and will dissolve substantial amounts of tungsten and will have a grain size of the order of from about 2 to about 4 μm.

US Pat. Appl. Publ. 2005/0126336 discloses a cemented carbide comprising WC, a binder phase based on Co, Ni or Fe and gamma phase in which said gamma-phase has an average grain size of less than about 1 μm. This is accomplished by adding the powders forming gamma phase with a WC-content in equilibrium at a temperature of about 1450° C., a typical sintering temperature, for Ti, Nb and Ta based gamma phase.

Coated cemented carbide inserts with binder phase enriched surface zone are today used to a great extent for machining of steel and stainless materials. Thanks to the binder phase enriched surface zone, an extension of the application area for cutting tool material has been obtained.

Methods or processes to make a cemented carbide containing WC, cubic phase (carbonitride) and binder phase with binder phase enriched surface zones are within the techniques referred to as gradient sintering and are known through a number of patents and patent applications. According to U.S. Pat. No. 4,277,283 and U.S. Pat. No. 4,610,931, nitrogen containing additions are used and sintering takes place in a vacuum whereas according to U.S. Pat. No. 4,548,786 the nitrogen is added in gas phase. The result is that the volume which previously was occupied by the cubic phase after its dissolution is occupied by liquid binder metal. Through this process, a binder phase enriched surface zone is created. The metal components in the dissolved cubic phase diffuse inwardly and are precipitated on available undissolved gamma phase present further in the material. The content of these elements therefore increases in a zone inside the binder phase enriched surface zone at the same time as a corresponding decrease in the binder phase content is obtained. Cracks grow easily in this zone, which has a decisive influence on the fracture frequency during machining. A method of eliminating this problem is disclosed in U.S. Pat. No. 5,761,593.

OBJECTS AND SUMMARY OF THE INVENTION

It is an object of the present invention to provide a binder phase enriched cemented carbide with improved toughness in which the resistance against plastic deformation remains essentially unchanged.

In one aspect of the invention there is provided a coated cemented carbide comprising WC, a binder phase based on Co, Ni or Fe and gamma phase and with a binder phase enriched surface zone essentially free of gamma phase wherein said gamma-phase has an average grain size less than about 1 μm.

In another aspect of the invention there is provided a method of making a coated cemented carbide comprising WC, a binder phase based on Co, Ni or Fe and gamma phase with a surface zone essentially free of gamma phase by powder metallurgical methods known in the art wherein the powders forming gamma phase are added as a cubic mixed carbide (Ti, Nb, Ta, W) C alloyed with an amount of WC given by the mol fraction of WC, $x_{WC}$, such that the ratio between $x_{WC}$ and the equilibrium gamma phase WC content at the sintering temperature expressed as mol fraction WC, $xe_{WC}$, $f_{WC}=x_{WC}/xe_{WC}$ is from about 0.6 to about 1.0, where the WC solubility at the sintering temperature is given by the relation $$xe_{WC}=(0.383*x_{TiC}+0.117*x_{NbC}+0.136*x_{TaC})/(x_{TiC}+x_{NbC}+x_{TaC}).$$

DETAILED DESCRIPTION OF THE PREFERRED EMBODIMENTS OF THE INVENTION

Figure 1:
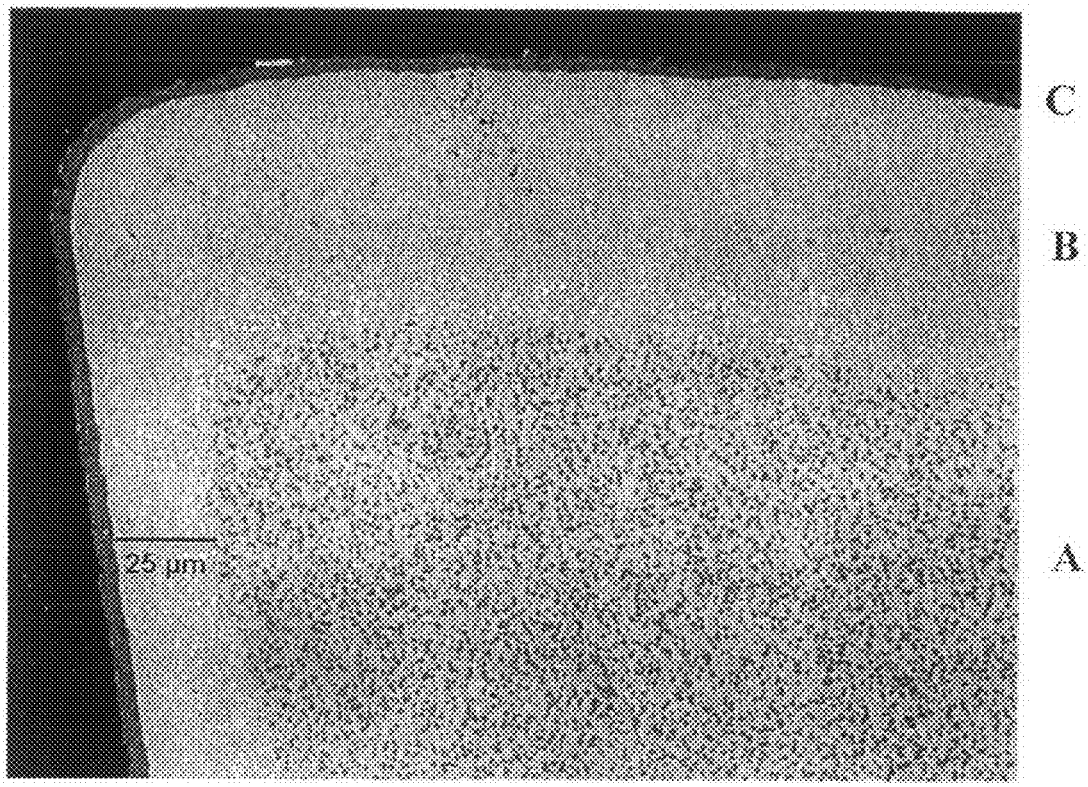
FIG. 1 shows a cross section of a coated cemented carbide insert according to the present invention in which A. interior portion of the cemented carbide B. binder phase enriched surface zone C. coating.

It has now surprisingly been found that the above mentioned object can be achieved with a binder phase enriched cemented carbide containing submicron gamma-phase.

According to the present invention there is now provided a coated cemented carbide comprising WC, a binder phase based on Co, Ni or Fe and gamma phase and with a binder phase enriched surface zone essentially free of gamma phase with an average grain size of less than about 1 μm. The binder phase content in the cemented carbide is from about 3 to about 15 wt-%, preferably from about 6 to about 12 wt-%. The amount of gamma phase from about 3 to about 25 vol-%, preferably from about 5 to about 15 vol-%. In a preferred embodiment, the average grain size of the WC is less than about 1 μm.

According to the present invention there is now provided a cemented carbide with a less than about 70 μm, preferably from about 10 to about 40 μm, thick binder phase enriched surface zone depleted in cubic carbide. The binder metal content in the surface zone of the cemented carbide body has a maximum content greater than about 1.1, preferably from about 1.25 to about 3, of the binder metal content in the inner position of the cemented carbide.

The present invention also relates to a method of making a cemented carbide comprising WC, a binder phase based on Co, Ni or Fe and gamma phase by conventional powder metallurgical methods of wet milling powders forming hard constituents and binder phase, drying pressing and sintering to bodies of desired shape and dimension. According to the invention, the powders forming gamma phase are added as a cubic mixed carbide (Ti,Nb,Ta,W)C alloyed with an amount of WC given by the mol fraction of WC, $x_{WC}$, such that the ratio between $x_{WC}$ and the equilibrium gamma phase WC content at the sintering temperature expressed as mol fraction WC, $xe_{WC}$, $f_{WC}=x_{WC}/xe_{WC}$ is from about 0.6 to about 1.0, preferably from about 0.8 to about 1.0, where the WC solubility at the sintering temperature is given by the relation $$xe_{WC}=(0.383*x_{TiC}+0.117*x_{NbC}+0.136*x_{TaC})/(x_{TiC}+x_{NbC}+x_{TaC}),$$

preferably with submicron grain size.

In a preferred embodiment, the WC-powder is also submicron.

Cemented carbide inserts are produced by powder metallurgical methods including; milling of a powder mixture forming the hard constituents and the binder phase including a small amount of N, drying, pressing and sintering under vacuum in order to obtain the desired binder phase enrichment. This is done in either of two ways or a combination thereof: (i) by sintering a presintered or compacted body containing a nitride or a carbonitride in an inert atmosphere or in vacuum as disclosed in U.S. Pat. No. 4,610,931, or (ii) by nitriding the compacted body as disclosed in U.S. Pat. No. 4,548,786 followed by sintering in an inert atmosphere or in vacuum. The amount of nitrogen, added either through the powder or through the sintering process or a combination thereof, determines the rate of dissolution of the cubic carbide phase during sintering. The optimum amount of nitrogen depends on the amount and type of cubic carbide phase and can vary from about 0.1 to about 8 wt %, as a percentage of the weight of the gamma phase forming elements. In case of method (i) nitrogen is added as TiN or Ti(C,N) or the above mentioned mixed carbide (Ti,Nb,Ta,W)C may be added as carbonitride.

The inserts may thereafter be coated by conventional techniques (e.g., CVD, PVD) with one or more layers of conventional coating materials, for example $Al_2O_3$, TiN, TiC, TiCN, TiAlN, etc. as understood by the skilled artisan.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

The invention claimed is:

1. Method of making a coated cemented carbide comprising WC, a binder phase based on Co, Ni or Fe and a gamma phase with a surface zone essentially free of gamma phase by powder metallurgical methods known in the art wherein the powders forming the gamma phase are added as a cubic mixed carbide (Ti,Nb,Ta,W)C alloyed with an amount of WC given by the mol fraction of WC, $x_{WC}$, such that the ratio between $x_{WC}$ and the equilibrium gamma phase WC content at the sintering temperature expressed as mol fraction WC, $xe_{WC}$, $f_{WC}=x_{WC}/xe_{WC}$ is from about 0.6 to about 1.0, where the WC solubility at the sintering temperature is given by the relation $$xe_{WC}=(0.383*x_{TiC}+0.117*x_{NbC}+0.136*x_{TaC})/(x_{TiC}+x_{NbC}+x_{TaC}).$$

2. The method according to claim 1, wherein the gamma phase powders have a grain size less than about 1 μm.

3. The method of claim 1, wherein the WC-powder is submicron.

4. The method of claim 1, wherein the cubic mixed carbide (Ti,Nb,Ta,W)C contains nitrogen.

5. The method of claim 1, wherein the mol fraction WC is from about 0.8 to about 1.0.

6. The method of claim 1, wherein the binder phase content is from about 3 to about 15 wt-%.

7. The method of claim 6, wherein the binder content is from about 6 to about 12 wt-%.

8. The method of claim 1, wherein the amount of gamma phase is 3-25 vol-%.

9. The method of claim 8, wherein the amount of gamma phase is from about 5 to about 15 vol-%.

10. The method of claim 1, wherein the average grain size of the WC is less than about 1 μm.

11. The method of claim 1, wherein a thickness of a portion of a binder phase enriched surface zone is about 65 μm.

12. The method of claim 1, wherein a thickness of a portion of a binder phase, enriched surface zone is 10 μm to 70 μm.

* * * * *